US005267898A

United States Patent [19]

Doll et al.

[11] Patent Number: 5,267,898

[45] Date of Patent: Dec. 7, 1993

[54] MULTI-PLY CLEAN RELEASE LABEL, FORM OR MAILER

[75] Inventors: Gary Doll, Englewood; David F. Laurash, Bellbrook, both of Ohio

[73] Assignee: The Standard Register Company, Dayton, Ohio

[21] Appl. No.: 903,245

[22] Filed: Jun. 23, 1992

[51] Int. Cl.[5] ..... B42D 15/00

[52] U.S. Cl. ..... 462/6; 462/26; 224/300

[58] Field of Search ..... 462/6, 25, 26, 29, 8, 462/9, 10, 12, 13; 229/68 R, 300; 283/81, 95

[56] References Cited

U.S. PATENT DOCUMENTS 3,315,386 4/1967 Kest et al. ..... 283/105 X
4,637,635 1/1987 Levine ..... 283/105 X
4,833,122 5/1989 Doll et al. .
4,889,877 12/1989 Seitz .
5,039,652 8/1991 Doll et al. .
5,071,167 12/1991 O'Brien .
5,084,492 1/1992 Pinell et al. .
5,139,286 8/1992 Gold ..... 283/105

*Primary Examiner*—Mark Rosenbaum
*Assistant Examiner*—Willmon Fridie, Jr.
*Attorney, Agent, or Firm*—Killworth, Gottman, Hagan & Schaeff

[57] ABSTRACT

A multi-ply form or label which utilizes a clean release adhesive for securing one or more of the plies together is provided. Different embodiments provide a laminated postal card or mailer having a return envelope or a multi-ply product label. In all of these embodiments of the invention, the plies of the label, postal card, or form are secured together in a manner which withstands rough handling and minimizes lost or torn plies. The various embodiments of the invention also include both preprinted information as well as the capability to record variable information on more than one ply in a single printing pass.

17 Claims, 10 Drawing Sheets

MULTI-PLY CLEAN RELEASE LABEL, FORM OR MAILER

BACKGROUND OF THE INVENTION

This invention relates to a multi-ply label, form, or postal card having multiple plies, and more particularly to such a label, form, or card which utilizes a clean release adhesive for securing the plies together.

Shipping labels, package invoices, return postal cards, and the like have found increasing use in recent years as delivery services have proliferated. Currently, multi-part labels and forms are applied to merchandise which is shipped both to residences and commercial locations. Typically, the individual plies of such forms are secured together along one or more edges by a glue or other adhesive. There may be carbon paper positioned between plies for recording information simultaneously on more than one ply. Alternatively, carbonless coatings may be used. Different plies of the forms may be removed and retained by the shipper, delivery agent, and/or recipient. Different plies of the form may act as address labels, invoices, receipts, or return slips.

Shipping labels currently used in the art include both nonvariable preprinted information on each ply and variable information added either by machine or manually to selected plies. Additionally, with increasing use in the field by delivery agents of scanning devices equipped with microprocessors to record information, bar codes and/or other optically readable information must also be printed on such labels. Depending upon the design of the label or form, such information may be contained on more than one layer or ply of the label.

One major problem with currently used collated shipping labels and the like is that after the multi-ply labels or forms are secured to a package, one or more of the plies of the label may become dislodged or separated because of the rough handling of the package during shipment. As the label plies are typically secured only along a single edge, the remaining loose edges on the labels tend to catch and be torn during shipment and handling so that a portion of the label or form may be missing when the package reaches its destination. Some shippers have resorted to placing shipping labels and forms in transparent plastic pouches which are secured to the package. However, this increases the cost per label or form, and also involves additional handling as the form must be stuffed into and removed from the pouch.

Another major problem with current labels and forms is that variable machine-readable information requires printing in multiple passes prior to assembly of the label plies. This requires additional printing steps and may also cause problems in assembling the plies correctly with the information contained on each ply in proper registration with the other plies in the construction.

Another problem with current labels and forms is that when the recipient receives an invoice as a part of such a label or form, the recipient must then supply and correctly address his or her own envelope for payment. It would be desirable to be able to include a preaddressed return envelope with such an invoice to insure that payments by the recipient are correctly returned in the mails.

Accordingly, there remains a need in the art for a multi-ply label or form which can withstand the rough handling which occurs during shipment of a package without tearing or separation of the plies. Further, there remains a need in the art for the capability to print machine-readable information on more than one ply of a multi-ply label or form a single pass. Yet further, there remains a need for a multi-ply form or label which includes a return envelope as part of its construction.

SUMMARY OF THE INVENTION

The present invention meets those needs by providing a multi-ply form or label which utilizes a clean release adhesive for securing one or more of the plies together. The present invention also provides, in another embodiment, a laminated postal card or mailer having a return envelope. In yet other embodiments, multi-ply product labels are provided. In all of these embodiments of the invention, the plies of the label, postal card, or form are secured together in a manner which withstands rough handling and minimizes lost or torn plies. The various embodiments of the invention also include both preprinted information as well as the capability to record variable information, both human and machine readable, on more than one ply in a single printing pass.

According to one aspect of the present invention, a multi-ply form or label adapted to be secured to a substrate is provided and includes a top ply, a base ply, and at least one intermediate ply. A lower surface of the top ply is secured to the intermediate ply along at least one marginal edge thereof by an adhesive. The top ply may include perforations interiorly of the adhesive to permit removal of the top ply from the remainder of the form.

The lower surface of the top ply which faces the intermediate ply may include at least one area printed with a first composition which, when exposed to a second composition, forms a distinctive color, with at least one of the first and second compositions being contained in frangible microcapsules. The upper surface of the intermediate ply includes at least one area printed with the second composition which, when exposed to the first composition on the top ply, forms a distinctive color. In more common terminology, the lower surface of the top ply contains a CB carbonless coating and the upper surface of the intermediate ply has a CF carbonless coating. As will be appreciated, the location of the respective compositions may be reversed, and the same result is still achieved. Alternatively, the upper surface of the intermediate ply may have a self-contained carbonless coating thereon, eliminating the need for any coating on the lower surface of the top ply. Application of an impact force on the top ply, either by hand or a machine printer, causes the same information to appear on the surface of the intermediate ply in the area of the CF or self-contained coating.

The intermediate and base plies are secured together with a releasable adhesive such that the plies are readily separable. When separated, the intermediate ply can be used as a tack-free receipt, invoice, or the like. The upper surface of the base ply which faces the intermediate ply also includes at least one area printed with a first composition which, when exposed to a second composition, reacts to form a distinctive color, with at least one of the first and second compositions being contained in frangible microcapsules, the encapsulated composition being present either blended with its co-reactant on the upper surface of the base ply (i.e., self-contained) or blended with the releasable adhesive. Again, application of an impact force to the top ply of the construction causes the same information to appear on the surface of the base ply in the area printed or coated with the first composition.

To secure the form to a substrate, the lower surface of the base ply preferably includes an adhesive selected from the group consisting of water remoistenable adhesives and pressure sensitive adhesives. The water remoistenable adhesive may be applied either when the form or label is manufactured, or by the user immediately prior to application of the form or label to a substrate such as a package or product. If a pressure sensitive adhesive is used, a release liner may be used to cover and protect the pressure sensitive adhesive surface until application of the form or label to a substrate.

In some forms of the invention, the base ply extends beyond at least one edge of the intermediate ply. The top ply also preferably includes at least one area which has been die cut to expose a portion of the upper surface of the intermediate ply. In this manner, the manufactured construction can have information printed simultaneously onto the top ply, intermediate ply (in the die cut area), and base ply (in the area extending beyond the edge of the intermediate ply). This information may be either human or machine readable indicia (such as OCR scannable or bar code information) printed on each of the top, intermediate, and base plies.

In an embodiment of the invention where a return envelope is provided as part of the form construction, the lower surface of the top ply is secured to the upper surface of the intermediate ply along three marginal edges thereof. Once removed from the construction, these two plies then form the front and back sides of an envelope. In embodiments of the invention where a return envelope is provided, imaging coating between the top and intermediate plies which form the return envelope are not needed.

In another embodiment of the invention, a laminated postal card or mailer having a return envelope is provided including a top ply, a base ply, and an intermediate ply. The intermediate and base plies are secured together with a releasable adhesive such that the plies are readily separable to provide a non-tacky receipt or invoice for a recipient when the base ply is removed from the construction. The top and intermediate plies are secured together along three marginal edges thereof by an adhesive to form a return envelope overlying the base ply. The lower surface of the intermediate ply may include a preprinted return address including a postal bar code.

The upper surface of the base ply which faces the intermediate ply includes at least one area printed with a first composition which, when exposed to a second composition, forms a distinctive color, with at least one of the first and second compositions being contained in frangible microcapsules, the second composition being present either blended with the first composition on the upper surface of the base ply or coated onto the lower surface of the intermediate ply. Application of an impact force on the top ply, either by hand or a machine printer, causes the information to appear on the surface of the base ply in the area of the printed composition due to the carbonless imaging system. The upper surface of the top ply may also include an area with a self-contained carbonless coating. In this manner, use of an impact printer with no ribbon or an uninked ribbon can provide addressee information simultaneously to the top and base plies while imaging confidential information only on the upper surface of the base ply.

The top ply further preferably includes a removable stub along one edge thereof, and the upper surface of the intermediate ply includes a coating of a remoistenable adhesive in the area directly above the removable stub. This provides a means of sealing the return envelope.

In still another embodiment of the invention, a package invoice with a return envelope is provided comprising a top ply, a base ply, and an intermediate ply. The top and intermediate plies are secured together along three marginal edges thereof by an adhesive to form a return envelope. The top ply also preferably includes a removable stub along one edge thereof, and the upper surface of the intermediate ply facing the top ply includes a coating of a remoistenable adhesive, or alternatively a layer of transfer adhesive tape with a release liner to protect the adhesive until use, in the area directly beneath the removable stub to be able to seal the return envelope.

The upper surface of the top ply includes at least one area printed with a first composition which, when exposed to a second composition, forms a distinctive color. At least one of the first and second compositions is contained in frangible microcapsules, with the second composition being present blended with the first composition. This provides a self-contained carbonless imaging system for the top ply.

The intermediate and base plies are secured together with a releasable adhesive such that the plies are readily separable. This permits the return mailer portion of the form to be cleanly separated from the remainder of the base ply. The upper surface of the base ply which faces the intermediate ply may also include at least one area printed with a first composition which, when exposed to a second composition, forms a distinctive color, with at least one of the first and second compositions being contained in frangible microcapsules. The second composition is present either blended with the first composition on the upper surface of the base ply or blended with the releasable adhesive to form a carbonless imaging system for the upper surface of the base ply.

As with other embodiments of the invention, the lower surface of the base ply preferably includes an adhesive selected from the group consisting of water remoistenable adhesives and pressure sensitive adhesives to secure the package invoice and return mailer to a substrate. Where a pressure sensitive adhesive is used, a release liner covers and protects the adhesive.

In yet another embodiment of the invention, a product label having an in-store coupon pocket and a hidden message is provided and includes a top ply, a base ply, and at least one intermediate ply. The top and intermediate plies are secured together along three marginal edges thereof by an adhesive to form a pocket for containing an in-store coupon. The upper surface of the top ply includes at least one area printed with a first composition which, when exposed to a second composition, forms a distinctive color, with at least one of the first and second compositions being contained in frangible microcapsules. The second composition is present blended with the first composition.

The intermediate and base plies are secured together with a releasable adhesive such that the plies are readily separable. The upper surface of the base ply which faces the intermediate ply includes at least one area printed with a first composition which, when exposed to a second composition, forms a distinctive color, with at least one of the first and second compositions being contained in frangible microcapsules. The second composition is present either blended with the first composition on the upper surface of the base ply or blended with the releasable adhesive. The upper surface of the base ply further includes printed indicia which forms a message which is hidden from view until the base and intermediate plies are separated. The construction also may include a coupon inserted into the pocket formed by the top and intermediate plies.

The lower surface of the base ply includes an adhesive selected from the group consisting of water remoistenable adhesives and pressure sensitive adhesives for adhering the construction to a substrate such as a plastic bottle or paperboard package.

Accordingly, it is an object of the present invention to provide a multi-ply form, postal card, or label which utilizes a clean release adhesive for securing one or more of the plies together. It is a further object of the present invention to provide plies of the form, postal card, or label which are secured together in a manner which withstands rough handling and minimizes lost or torn plies. It is a further object of the invention to provide both preprinted information as well as the capability to record variable information on more than one ply in a single printing pass. It is yet a further object of the invention to provide a multi-ply form or label which includes a return envelope as a part of its construction. These, and other objects and advantages of the present invention, will become apparent from the following detailed description, the accompanying drawings, and the appended claims.

DETAILED DESCRIPTION OF THE PREFERRED EMBODIMENTS

Figure 1:
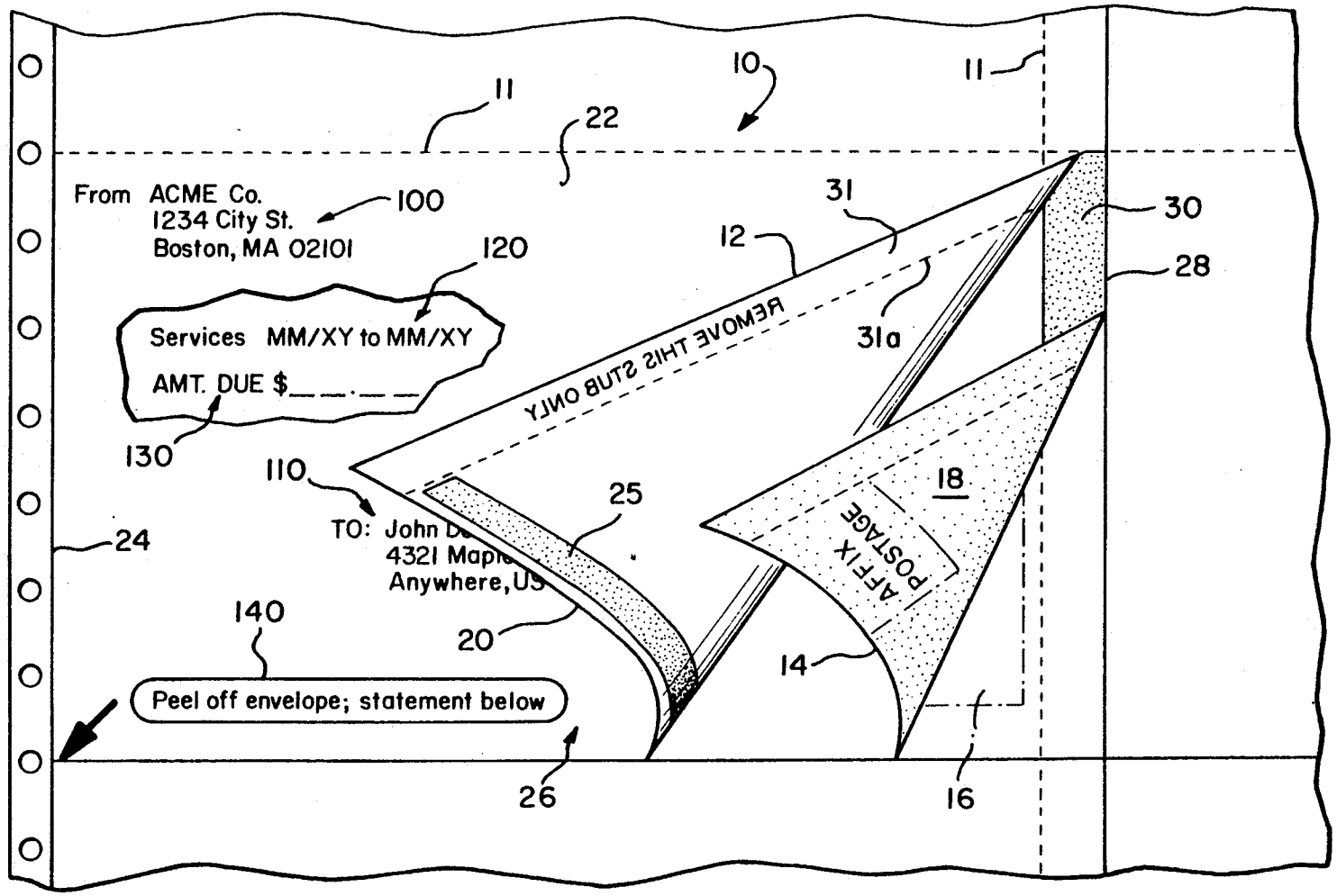
FIG. 1 is a front elevational view, with the plies partially peeled back, of a laminated postal card or mailer with a return envelope constructed in accordance with the present invention, and with an area broken out to show confidential information printed in the base ply.
Figure 2:
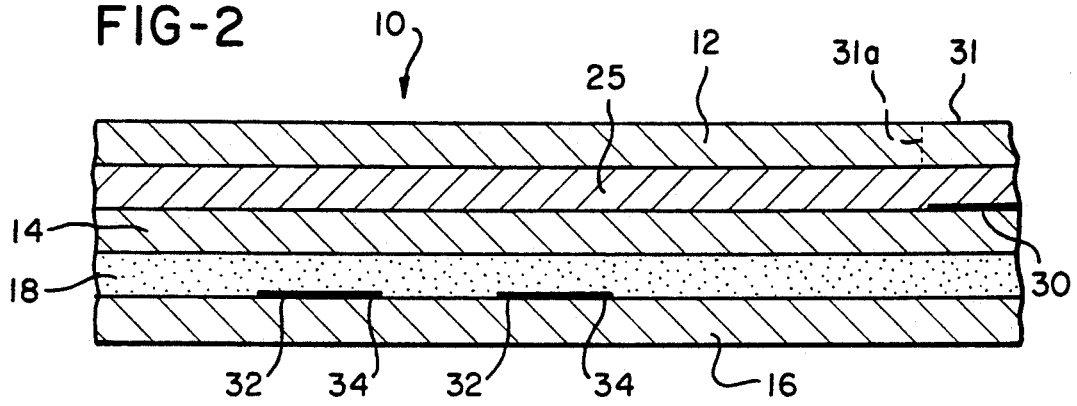
FIG. 2 is a cross-sectional view of the plies of the laminated postal card or mailer having a return envelope of FIG. 1.
Figure 13:
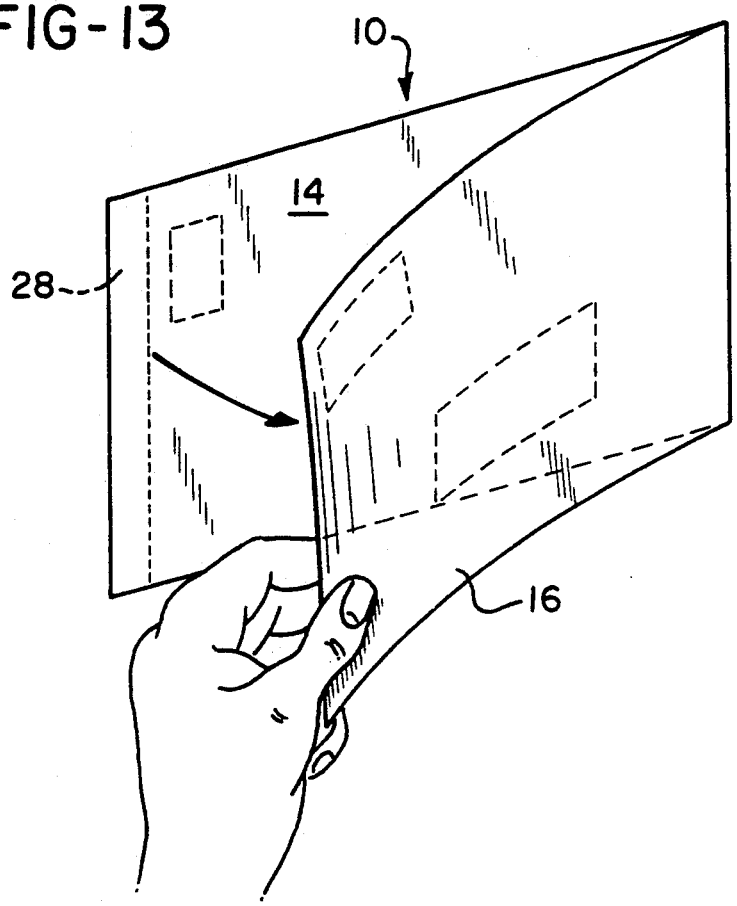
FIG. 13 is a perspective view of the laminated postal card or mailer with a return envelope as shown in FIGS. 1 or 3, illustrating the removal of the invoice ply from the return envelope.
Figure 14:
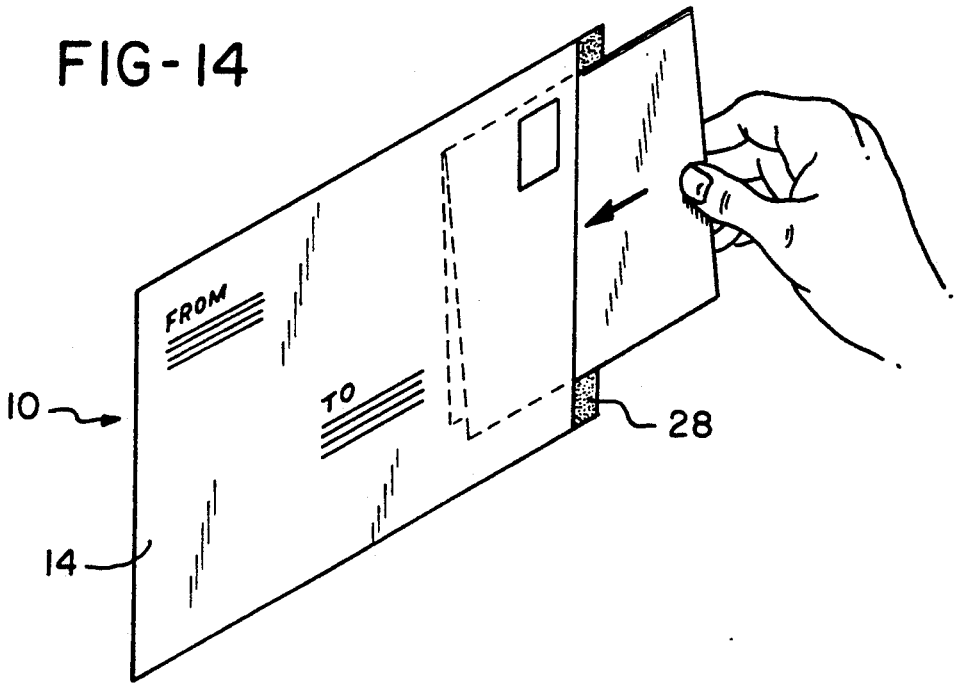
FIG. 14 is a perspective view of the return mailer portion of the construction of FIGS. 1 or 3, illustrating the placement of a check or other information in the return envelope.

Referring to FIGS. 1 and 2, in one embodiment of the present invention a laminated postal card or mailer with a return envelope 10 is provided. In this embodiment of the invention, a postal card containing billing or invoice information can be mailed to a recipient and will include a return envelope or mailer as part of the construction. Because of the lamination of the plies, the card will behave functionally as a single sheet when mailed to a recipient. The recipient can then delaminate the return envelope as shown in FIG. 13 and retain the bill or statement for record purposes. The preaddressed return envelope is then used by the recipient to return a payment, such as a check or money order, to the billing party as shown in FIG. 14.

As shown, a series of postal cards 10 may be preprinted as a continuous web. Repetitive information may be preprinted onto either or both surfaces of any of the plies of postal cards 10 during manufacture thereof. For example, the lower surface of the intermediate ply may be preprinted with a return address including the postal bar code of the sender. Other preprinted information may include the address of the sender 100 and instructions explaining to the recipient how to delaminate the construction and use the return envelope provided 140. Variable information may be printed onto the postal cards 10 in an automated printer, such as a dot matrix or other impact printing device. This information may include, for example, the address of recipient 110 (top ply), a statement for services 120 or goods (base ply), and an amount due 130 (base ply). While the address information is printed so as to be visible, the other information may remain confidential, hidden from view on the base ply, as illustrated by the section broken out of FIG. 1. Individual cards 10 may then be separated from the web by bursting along a series of perforations 11 extending both along the length and transversely of the individual cards.

Laminated postal card 10 includes a top ply 12, an intermediate ply 14, and a base ply 16. Typically, each of the plies will be of a paper or card stock of a suitable weight. However, other materials such as a thin plastic sheet may be used. The only requirements are that the material be substantially opaque, or be modified to be substantially opaque, printable, and that the top ply be sufficiently flexible so that when its surface is subjected to an imaging force, the information may be transferred through all of the plies. Suitable basis weights for the plies of material are in the range of between about 10 to about 100 pounds per ream ($17\times22\times500$ sheet ream), and preferably between about 15 to about 36 pounds per ream.

The lower surface of intermediate ply 14 is secured to base ply 16. In the construction shown in FIG. 1, the entire respective surfaces of the intermediate and base plies are secured together by a fugitive or releasable adhesive 18. A suitable releasable adhesive material for use in the invention may be any adhesive which has a low cohesive strength, bonds well to paper or plastic, and is nontacky to the touch when dry. The adhesive may be applied to a surface in a fluid state and then converted to a solid by heat, cooling, radiation, or a chemical reaction. Suitable classes of releasable adhesives include water based, hot melt, solvent based, and so-called 100% solids adhesives. Preferred adhesives are water-based polymer latexes or hot melts such as waxes or polymeric resins.

An especially preferred class of adhesives may be chosen from blends of polyvinyl acetate and polyethylene emulsions. Such blends are formulated by varying the ratio of these two emulsions. Such adhesives are commercially available and are described in greater detail in U.S. Pat. No. 4,833,122, the disclosure of which is incorporated by reference. The peel strength of these blends may be varied by varying the ratios of polyvinyl acetate to polyethylene.

Suitable physical properties for such a releasable adhesive are: a viscosity of from 3500 to 4500 centipoise at 30° C.; a specific gravity of 0.98 to 1.15 grams per cubic centimeter; an oven dry solids content of 43% to 58%; and a pH from 4.5 to 8.5. The adhesive is preferably applied at a rate of from about 3.0 to about 22.0 grams per square meter, and most preferably about 3.0 to about 12.0 grams per square meter, based on dry weight.

The releasable adhesive provides a uniform nonfiber tearing clean release from paper or plastic. Preferred release levels may be in the range of from about 100 to about 500 grams per five centimeters of width, although somewhat higher and lower values are operational. The release test is conducted at 90° peel at 1500 centimeters per minute by delaminating the two sheets. A releasable adhesive suitable for use in the present invention may generally be identified as one in which cohesive failure occurs as the one sheet is peeled from the other sheet. Cohesive failure is defined as that which occurs within the layer of adhesive. Adhesive failure is also acceptable. Adhesive failure is defined as failure at the interface between the adhesive and one of the surfaces it contacts.

The adhesive may be applied over substantially the entire area of the plies, may be confined to the peripheral edges only, or may be applied in any desired configuration which will ensure that the two plies will not delaminate prematurely. For example, the releasable adhesive may be applied in stripes across the surfaces of the plies. Additionally, one or more corners or edges of the laminate may be left free of adhesive to provide a clean lifting edge for delamination by the recipient. Upon separation, the bottom ply forms a non-tacky receipt or invoice for the recipient.

The top and intermediate plies are secured together along three marginal edges 20, 22, and 24 by an adhesive 25 to form the return envelope 26. Adhesive 25 may be any suitable permanent adhesive such as a hot melt adhesive. The lower surface of intermediate ply 14 preferably includes a preprinted return address (not shown). Edge 28 of intermediate ply 14 is coated with a water remoistenable adhesive 30 and is adapted to be wetted, folded over the end of return envelope 26, and sealed prior to return mailing. Alternatively, an adhesive transfer tape with protective release liner may be used in place of the water remoistenable adhesive. A stub 31 on top ply 12 is designed to be removed by the user to facilitate the folding and sealing of edge 28.

As best shown in FIG. 2, where the relative thicknesses of the respective layers are not drawn to scale, the upper surface of base ply 16 which faces intermediate ply 14 includes at least one area printed with a first composition 32 which, when exposed to a second composition 34, reacts to form a distinctive color. Preferably, at least one of the first and second compositions are contained in frangible microcapsules to prevent premature coloration and insure that a color forms only at a desired location. The second composition 34 is present either blended with the first composition 32 on the upper surface of base ply 16 or blended in releasable adhesive 18. In more common terminology, either a self-contained carbonless coating is carried on the upper surface of base ply 16, or a CF coating is carried on base ply 16 and CB capsules are blended in releasable adhesive 18.

The carbonless imaging compositions may be applied using in-line flexographic printing techniques which enable precise positioning of the imaging compositions on the plies. Alternatively, the compositions may be coated over substantially the entire respective surfaces of the plies. The color forming composition is preferably a high-solids CB ink as described in U.S. Pat. No. 4,889,877, the disclosure of which is incorporated by reference. The color developing composition is preferably also a high-solids (CF) ink as described in U.S. Pat. No. 4,874,832, the disclosure of which is incorporated by reference.

Application of an impact force on the top ply, either by hand or an impact printer, causes the same information to appear on the surface of the base ply due to the carbonless imaging system. Thus, printing of the addressee information 110 on top ply 12 causes the same information to be duplicated on the upper surface of base ply 16.

As explained above, repetitive information is printed during manufacture on either or both surfaces of any of the plies. Variable information is entered on the upper surface of top ply 12 by an impact printer or handwriting. Replicate images are formed on the areas which have been coated with carbonless imaging compositions. Typically, such variable information includes the name and address of the recipient. By the use of a printer with no ribbon or an uninked ribbon, other information such as services and billing amounts 120, 130 may also be entered onto other areas on the upper surface of base ply 16 where carbonless imaging compositions 32, 34 have been coated as shown in FIG. 2.

Such confidential information will not appear on the face of the outgoing postal card 10 because no carbonless imaging compositions have been coated onto the upper surface of top ply 12 in those confidential areas. As explained above, the carbonless imaging compositions may be CF coated areas with CB capsules in the releasable adhesive 18, or may be self-contained carbonless coatings.

The recipient peels off the base ply 16 of postal card 10 and reads the information contained on that ply. All or a portion of base ply 16 may be inserted into the return envelope as shown in FIG. 14 along with payment such as a check. The marginal stub 31 is torn off along the perforation line 31*a*, the remoistenable adhesive 30 activated, and the flap folded over to seal the return envelope for return mailing. Alternatively, an adhesive transfer tape with protective release liner may be used in place of the water remoistenable adhesive, and the release liner removed to seal the flap. Preferably, the original outgoing address and the tear off stub are positioned so that when the stub is removed and the flap folded over, the outgoing address is either removed or at least partially covered over by the flap.

Figure 4:
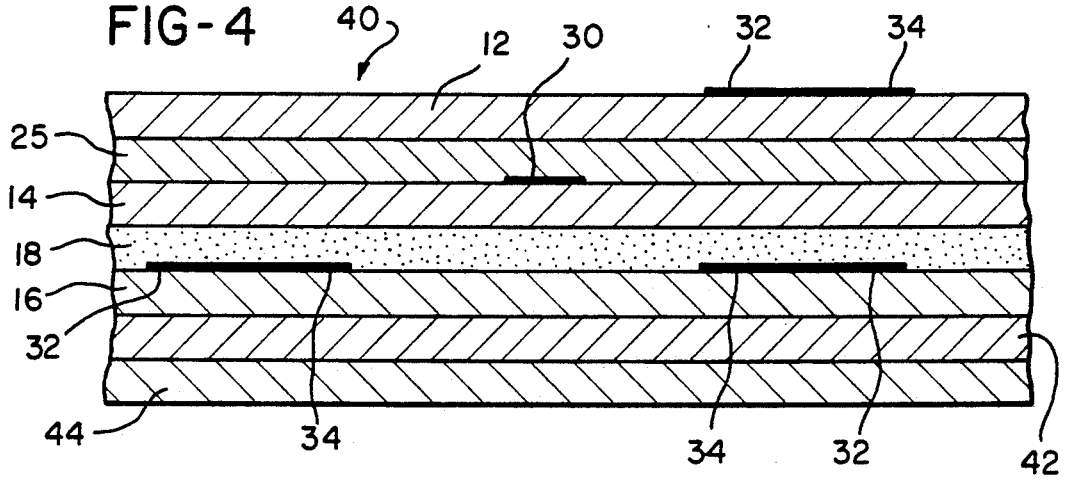
FIG. 4 is a cross-sectional view of the plies of the package invoice with a return envelope of FIG. 3.
Figure 3:
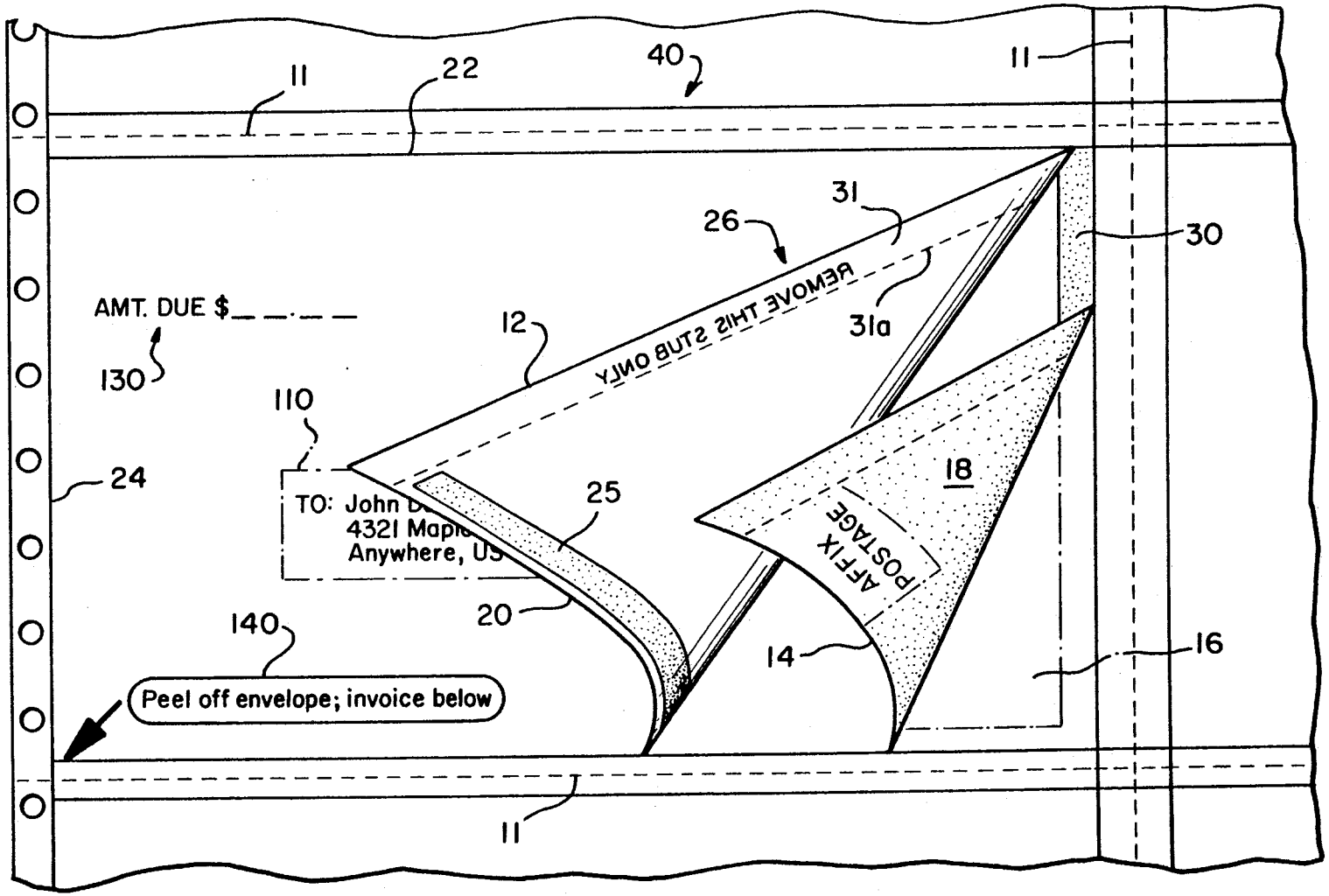
FIG. 3 is a front elevational view, with the plies partially peeled back, of a package invoice with a return envelope constructed in accordance with the present invention.

In the embodiment of the invention illustrated in FIGS. 3 and 4, where like elements are identified by like reference numerals, a package invoice with return mailer is provided. In this embodiment of the invention, an invoice or statement can be affixed to a package to be delivered. Upon receipt of the package, the recipient can delaminate the top layers of the construction and use them as a return envelope for payment purposes. The top and intermediate plies of the construction may be used as a return envelope for payment of the amount due.

As shown, a series of invoices 40 with return mailers may be preprinted as a continuous web. Variable information may be printed onto the invoices 40 in an automated printer, such as a dot matrix or other impact printing device. This information may include, for example, the address of the sender (not shown) and recipient 110, a statement of the amount due for the delivered goods 130, and instructions 140 explaining to the recipient how to delaminate the construction and use the return envelope provided. Individual invoice constructions 40 may then be separated from the web by bursting along a series of perforations 11 extending both along the length and transversely of the individual invoices.

As shown in FIG. 3, the invoice with a return envelope includes a top ply 12, a base ply 16, and an intermediate ply 14. The top and intermediate plies are secured together along three marginal edges 20, 22, and 24 thereof by an adhesive 25 to form a return envelope 26. Top ply 12 also preferably includes a removable stub 31 and perforation 31*a* along one edge thereof, and the upper surface of intermediate ply 14 facing top ply 12 includes a coating of a remoistenable adhesive 30 in the area directly beneath the removable stub 31 to be able to seal the return envelope.

As best shown in FIG. 4, the upper surface of top ply 12 includes at least one area printed with a blend of first and second compositions 32 and 34, with at least one of the first and second compositions being contained in frangible microcapsules to form a self-contained carbonless spot coating. This provides a self-contained carbonless imaging system for the upper surface of the top ply.

The intermediate and base plies 14, 16 are secured together with a releasable adhesive 18 such that the plies are readily separable. This permits the return envelope portion 26 of form 40 to be separated cleanly from the remainder of the form. The upper surface of base ply 16 which faces intermediate ply 14 may also include at least one area printed with first composition 32. Second composition 34 is either blended with first composition 32 on the upper surface of base ply 16 or blended with releasable adhesive 18 to form a carbonless imaging system for the surface of the base ply. At least one of the first and second compositions is contained in frangible microcapsules.

To secure invoice form 40 to a substrate such as a package, the lower surface of base ply 16 includes an adhesive 42 selected from the group consisting of water remoistenable adhesives and pressure sensitive adhesives to secure the invoice and return envelope to the substrate. Where a pressure sensitive adhesive is used, a release liner 44 covers and protects the adhesive.

Figure 6:
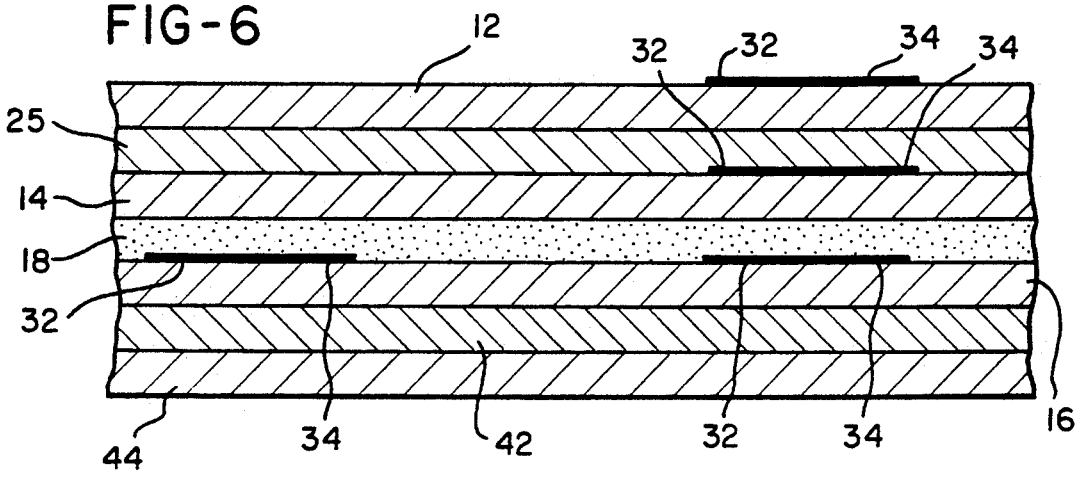
FIG. 6 is a cross-sectional view of the plies of the product label of FIG. 5.
Figure 5:
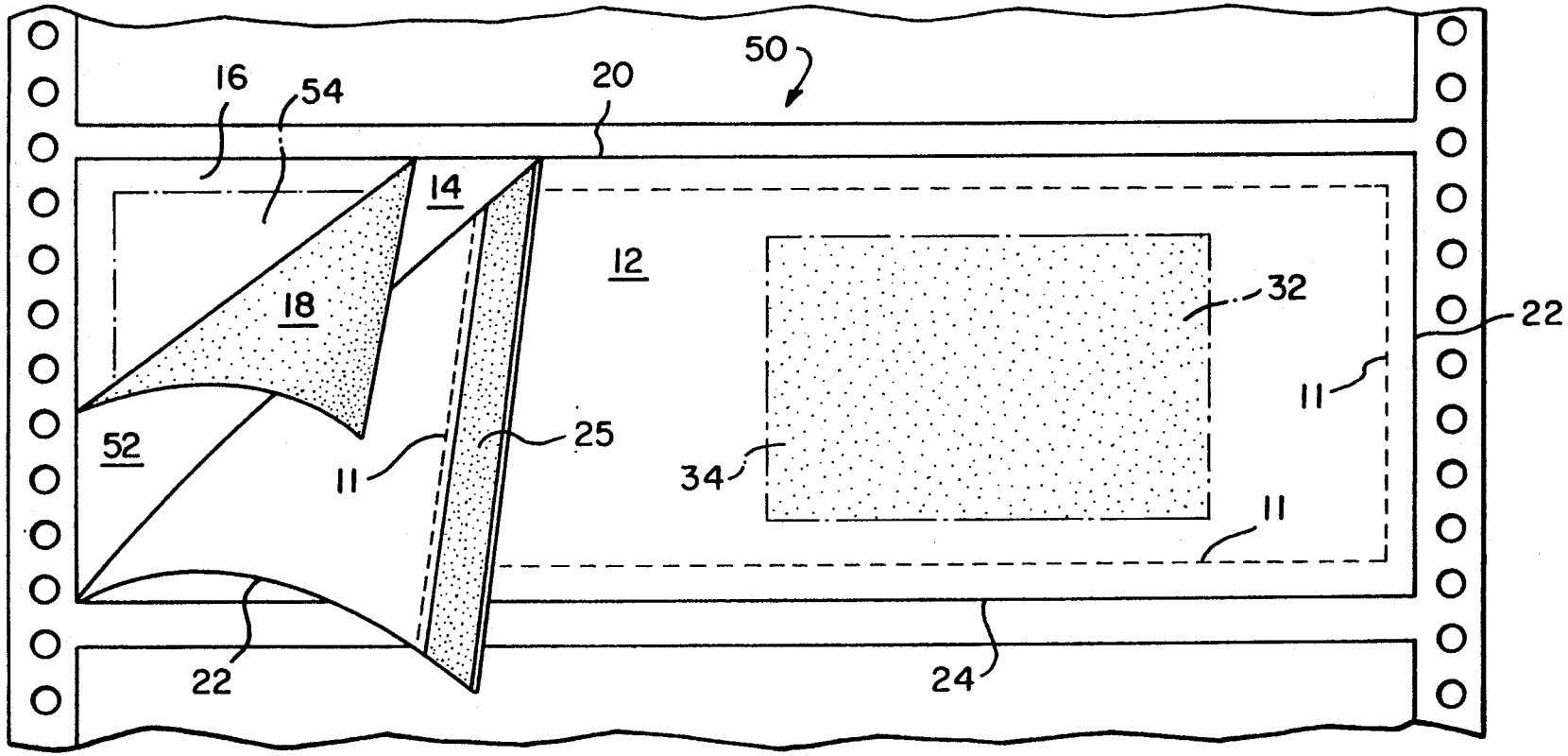
FIG. 5 is a front elevational view, with the plies partially peeled back, of a product label having a coupon pocket constructed in accordance with the present invention.
Figure 7:
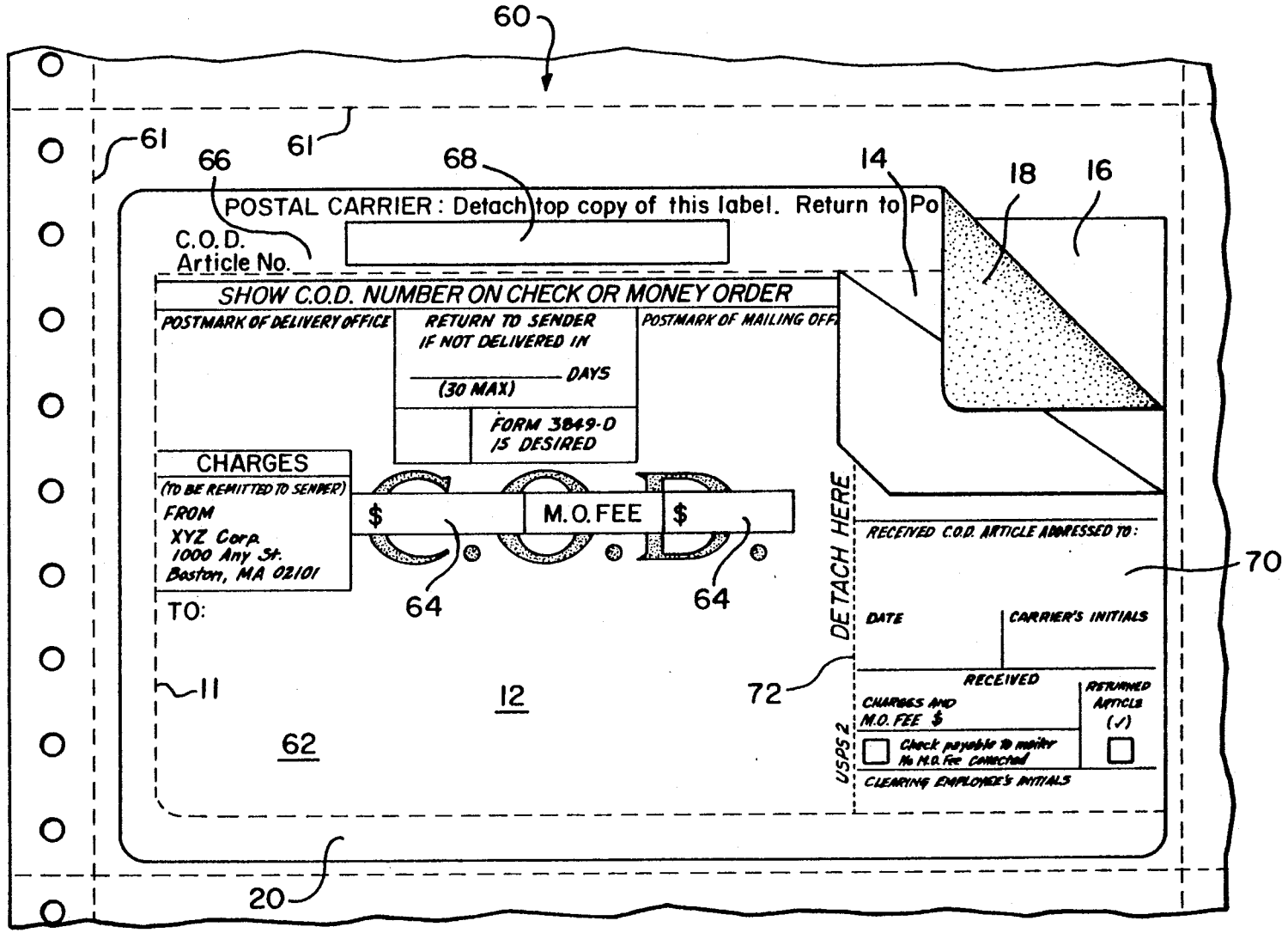
FIG. 7 is a front elevational view, with the plies partially peeled back, of a multi-ply form constructed in accordance with the present invention.
Figure 8:
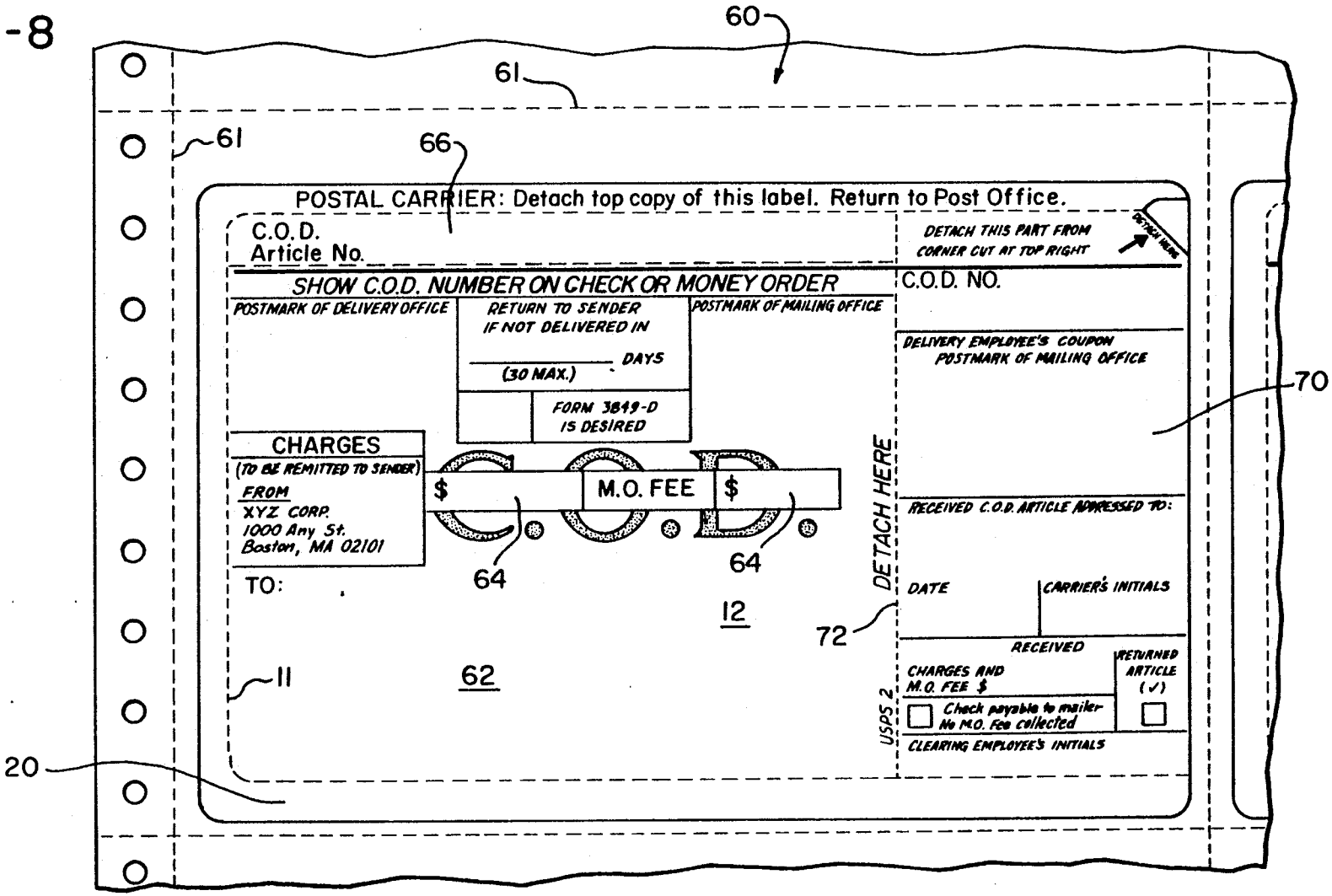
FIGS. 8–10 are front elevational views of the top, intermediate, and base plies of the multi-ply form of FIG. 7.
Figure 9:
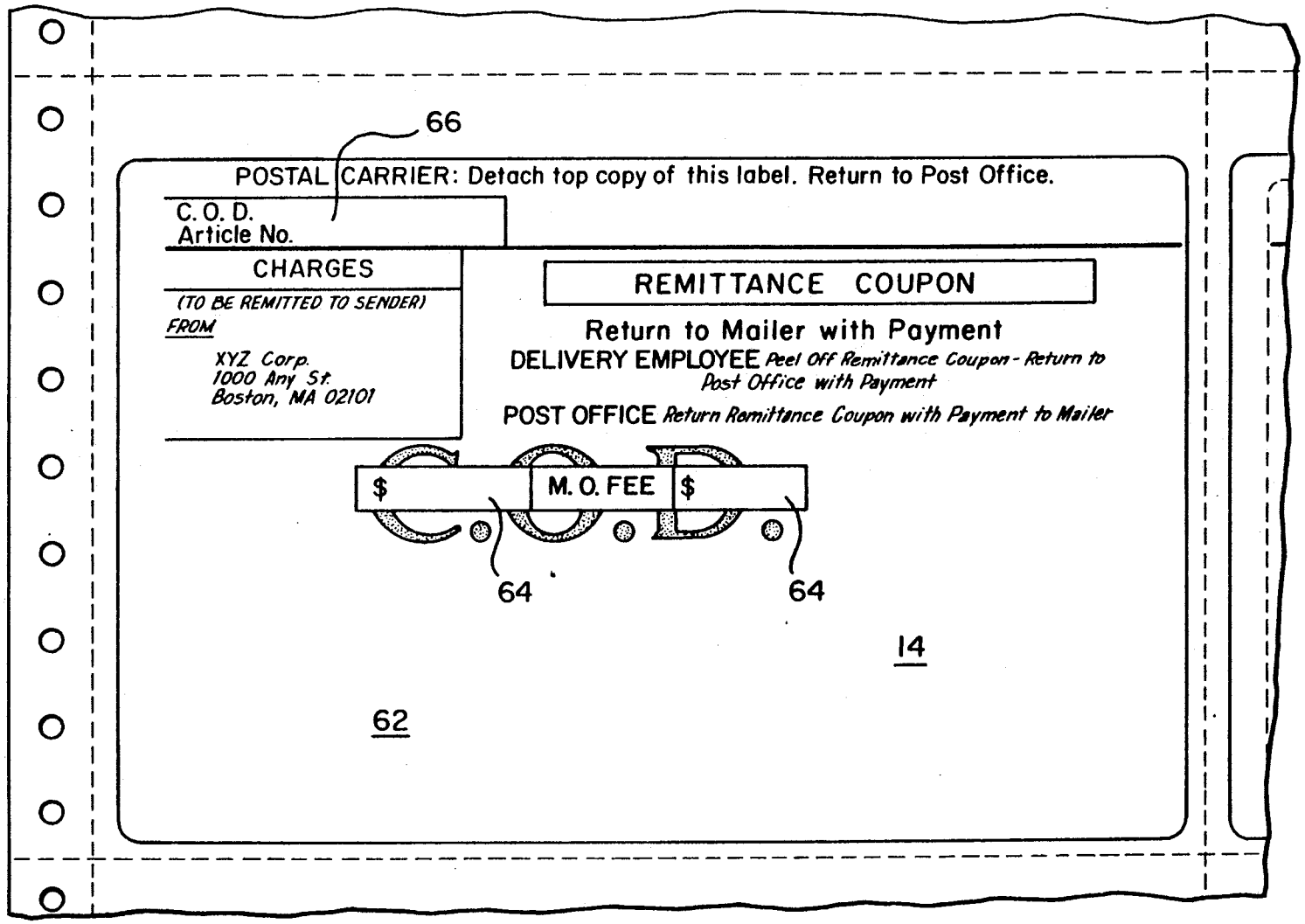
Figure 10:
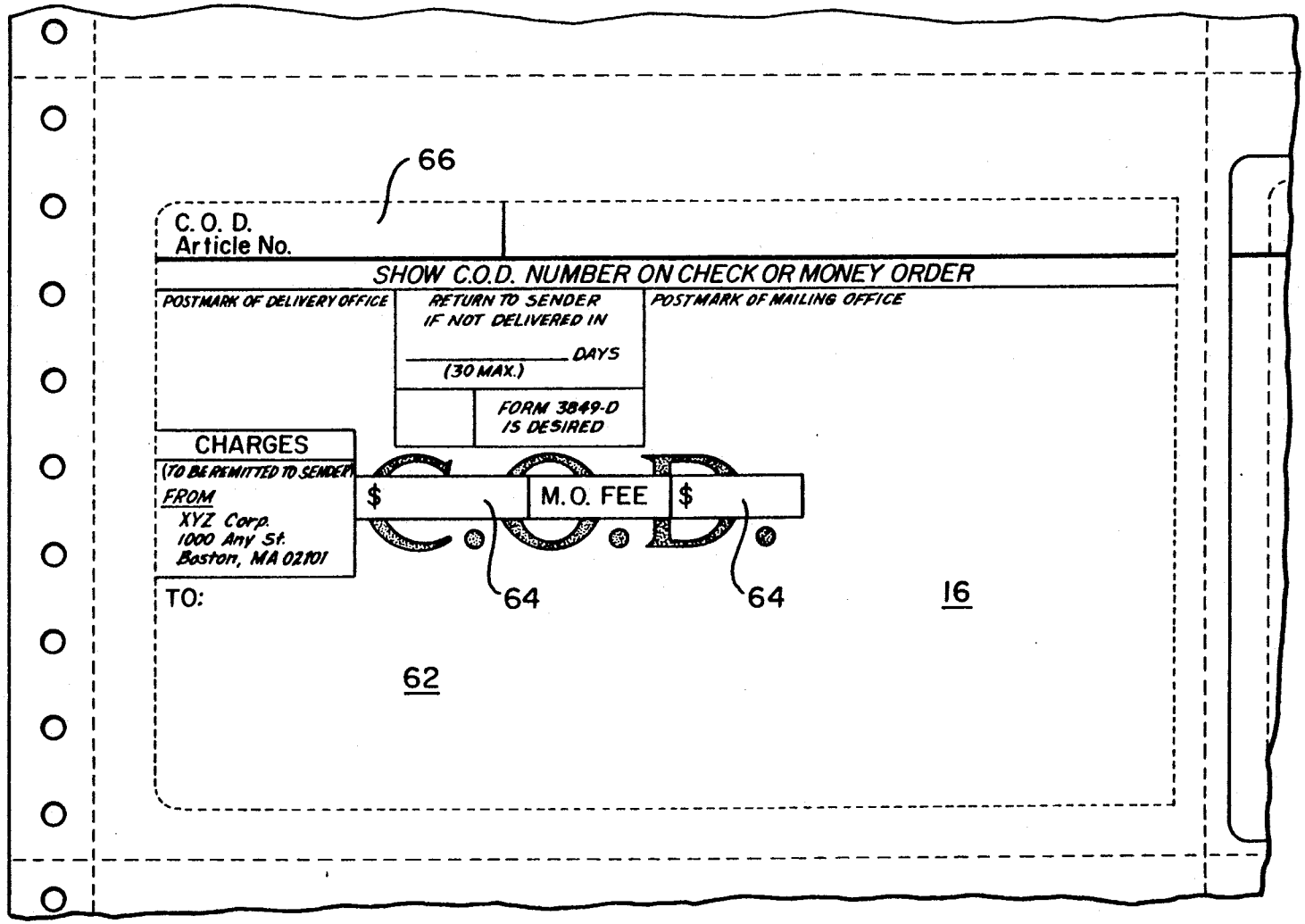

In the embodiment of the invention illustrated in FIGS. 5 and 6, a product label 50 having an in-store coupon pocket 52 and a hidden message in area 54 is provided. The product label includes a top ply 12, a base ply 16, and at least one intermediate ply 14. The top and intermediate plies are secured together along three marginal edges 20, 22, and 24 thereof by an adhesive 25 to form pocket 52 for containing an in-store coupon or the like. The upper surface of top ply 12 may include at least one area printed with blended first and second compositions 32 and 34 to form a self-contained carbonless imaging system. At least one of the first and second compositions are contained in frangible microcapsules. The lower surface of top ply 12 may also include at least one area printed with first composition 32 to form a CB coating which is capable of forming a color when contacted with CF coating composition 34 on the upper surface of intermediate ply 14.

The intermediate and base plies 14, 16 are secured together with a releasable adhesive 18 such that the plies are readily separable. The upper surface of base ply 16 which faces intermediate ply 14 includes at least one area printed with first composition 32. Second composition 34 is blended with the first composition on the upper surface of base ply 16 or blended with releasable adhesive 18. At least one of the first and second compositions are contained in frangible microcapsules. The upper surface of base ply 16 further includes printed indicia (not shown) which forms a message which is hidden from view until the base and intermediate plies are separated. The construction also may include a coupon (not shown) inserted into the pocket formed by the top and intermediate plies.

The lower surface of base ply 16 includes an adhesive 42 selected from the group consisting of water remoistenable adhesives and pressure sensitive adhesives for adhering the product label 50 to a substrate such as a plastic bottle or paperboard package. Where a pressure sensitive adhesive is used, a release liner 44 covers the adhesive and protects it until use. Top ply 12 also may include perforations 11 located interiorly of the adhesive to permit opening and entry into the pocket 52.

In yet another embodiment of the invention which is illustrated in FIGS. 7–10, a multi-ply form 60 adapted to be secured to a substrate is provided and includes a top ply 12, a base ply 16, and at least one intermediate ply 14. As previously described, form 60 may be manufactured as part of a continuous series of forms. Further, as also described above, repetitive information may be preprinted at the time of manufacture on any of the plies. Preferably the base ply is a continuous web with longitudinally extending perforations 61. The other plies are discontinuous, having been die cut to form individual labels with the removal of the surrounding matrix. Individual forms may be detached along perforations 61.

FIGS. 7–10 illustrate a preferred form of the invention in which the plies form a COD postal label designed to be secured to goods for which a postal delivery, or other delivery service, employee collects an amount due from a recipient. A lower surface of top ply 12 is secured to intermediate ply 14 along at least one marginal edge 20 thereof by a permanent adhesive. Top ply 12 includes perforations 11 located interiorly of the adhesive to permit removal of the top ply from the remainder of the form 60. The lower surface of top ply 12 which faces intermediate ply 14 includes at least one area printed with a CB coating which, when impacted against a CF coating on the upper surface of intermediate ply 14 forms a distinctive color. At least one of the CB or CF coatings is contained in frangible microcapsules. In the embodiment shown, at least areas 62 (addressee), 64 (dollar amount), and 66 (article identification number) may include CB coatings on the lower surface of top ply 12 and corresponding CF coatings on the upper surface of intermediate ply 14. Application of an impact force on top ply 12, either by hand or a machine printer, causes the same information to appear on the surface of intermediate ply 14.

The intermediate and base plies 14, 16 are secured together with a releasable adhesive 18 such that the plies are readily separable. When separated, intermediate ply 14 can be used as a tack-free receipt, invoice, or the like. The upper surface of base ply 16 which faces the intermediate ply includes at least one area, preferably at least addressee area 62 and monetary amount areas 64, printed with first composition 32. Second composition 34 is either blended with the first composition on the upper surface of base ply 16 or blended with releasable adhesive 18. At least one of the first and second compositions being contained in frangible microcapsules. Again, application of an impact force to the top ply of the construction causes information to appear on the surface of the base ply.

As previously described, to secure the form 60 to a substrate, the lower surface of base ply 16 preferably includes an adhesive selected from the group consisting of water remoistenable adhesives and pressure sensitive adhesives. The water remoistenable adhesive may be applied either when the form is assembled, or by the user immediately prior to application of the form to a substrate such as a package. If a pressure sensitive adhesive is used, a release liner may be used to cover and protect the pressure sensitive adhesive surface until application of the form to a substrate.

As shown in FIGS. 7–10, base ply 16 extends beyond at least one edge of intermediate ply 14. Top ply 12 also preferably includes at least one area 68 which has been die cut to expose a portion of the upper surface of intermediate ply 14. In this manner, the assembled form 60 can have machine readable information printed onto top ply 12, intermediate ply 14 (in the die cut area 68), and base ply 16 (in the area extending beyond the edge of the intermediate ply). This information may be bar codes or OCR readable indicia printed on each of the top, intermediate, and base plies.

The form 60 is fabricated as follows. The individuals plies are formed from continuous webs. First, the plies are passed through one or more printing stations where repetitive information is printed onto one or both sides of each ply. Carbonless coatings are also applied. In this embodiment, a CB coating is applied to the lower surface of the top ply and a CF coating is applied to the upper surface of the intermediate ply. The coating may be full or pattern coated. Likewise, coating for the lower surface of the intermediate ply and upper surface of the base ply are applied. If a self contained coating is used, there is no need for the CB coating on the lower surface of the top or the intermediate ply.

Two of the plies (e.g., top and intermediate) are adhered by a permanent adhesive such as a hot melt adhesive applied in a pattern form around two edges of the plies. The pattern of adhesive is smaller than the size of the finished form. Die cuts can be made at this time through the plies so that the cuts are slightly outside the adhesive pattern. Other die cutting and perforations may also be performed.

A releasable adhesive is then fully coated onto the desired ply surface (e.g., lower surface of intermediate ply), and the plies are brought together for lamination and drying. At a label press, repetitive printing is applied to the composite web. Variable numbering may also be printed (OCR, bar code, or human readable) at this stage. Because of the die cutting operations, this numbering can be simultaneously printed onto all three plies of the laminate.

A customer may then print variable individualized information onto the form using an impact printer. Images are produced on the top ply as well as on underlying plies where the carbonless coatings have been applied. If identifying numbers have not yet been applied, they can also be printed at this time. After the forms on a continuous web have passed through the printer, margins are trimmed off and individual forms are burst from the web. Glue is applied to the back of the form, and the form is applied to a package to be delivered COD. Alternatively, an adhesive (remoist or pressure sensitive) may have been applied during lamination of the form allowing the form to be adhered without having to apply it at the point of use. Again, if pressure sensitive adhesive is used, it is preferably covered by a release liner.

The delivery person at the time of delivery may enter additional information by hand on the upper surface of top ply 12 and then removes top ply 12 by tearing along the perforations 11. Top ply 12 may be divided into two sections by a vertical perforation 72. The delivery person keeps stub 70 by detaching along perforation line 72, while the recipient retains the other portion of the top ply. If the addressee decides not to accept the item, intermediate and base plies 14 and 16 remain with the package. If the item is accepted and payment made, intermediate ply 14 is peeled off and returned with the payment by the delivery person.

Figure 11:
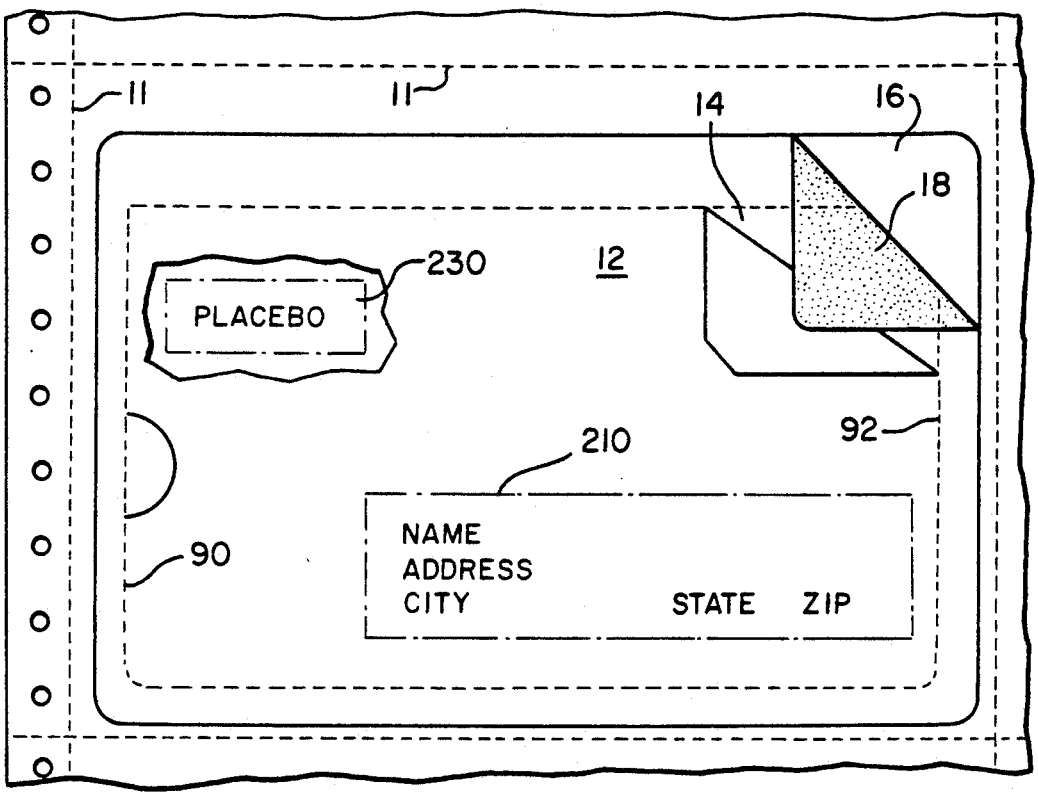
FIG. 11 is a front elevational view, with the plies partially peeled back, of a test label constructed in accordance with the present invention.
Figure 12:
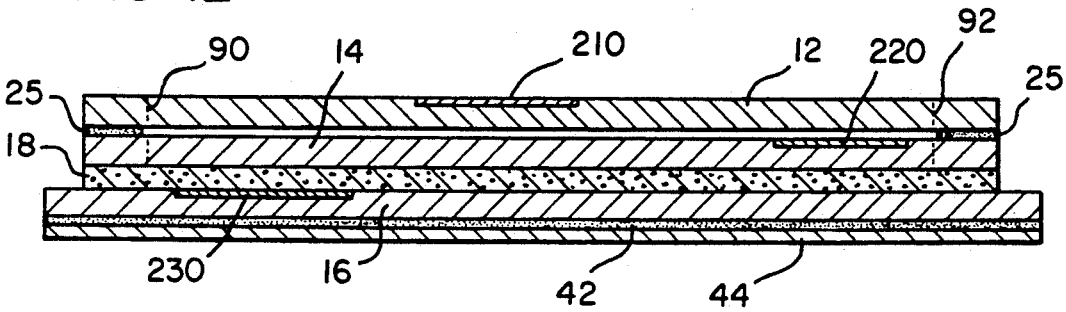
FIG. 12 is a cross-sectional view of the plies of the test label of FIG. 11.

Referring now to FIGS. 11 and 12, a test label construction which is similar to the delivery label is shown. The label includes a top ply 12, intermediate ply 14, and base ply 16. The intermediate and base plies are adhered together by releasable adhesive 18, while top ply 12 and intermediate ply 14 are joined along at least two margins thereof by a permanent adhesive 25. Such a label may be used, for example, for the labeling of containers of drugs used in clinical testing. For such testing, it is critical that neither the person dispensing the drugs nor the recipient know whether the item dispensed is the actual drug or a placebo.

As shown, top ply 12 includes a self-contained carbonless imaging area 210 on at least one location on its upper surface. Top ply 12 may also be removable from intermediate ply 14 by tearing along perforations 90, 92, located interiorly of permanent adhesive 25. Other imaging areas 220 and 230 are also present on the upper surfaces of the intermediate and base plies. Such imaging areas may be a self-contained carbonless imaging composition, or CF coatings with CB encapsulated coating located immediately over them on the lower surface of the top ply or blended with the releasable adhesive joining the base and intermediate plies together.

Individualized information may be entered by an impact printer with no ribbon or an uninked ribbon. Thus, some of the information will appear on top ply 12, some on intermediate ply 14, and some on base ply 16. The information 230 identifying the contents of a package as either a drug or placebo appears only on the base ply and is accessible only after both the top and intermediate plies have been removed.

The lower surface of base ply 16 may have an adhesive 42, such as a water remoistenable or pressure sensitive adhesive, applied to it during manufacture. If a pressure sensitive adhesive is used, a protective liner 44 covers the adhesive.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A multi-ply form or label adapted to be secured to a substrate comprising:

a top ply, a base ply, and at least one intermediate ply;

a lower surface of said top ply secured to said intermediate ply along at least one marginal edge thereof by an adhesive; and said intermediate and base plies being secured together with a releasable adhesive located between said intermediate and base plies such that said plies are readily separable, the upper surface of said base ply which faces said intermediate ply including at least one area printed with a first composition which, when exposed to a second composition, reacts to form a distinctive color, with at least one of said first and second compositions being contained in frangible microcapsules, and said second composition being in contact with said first composition.

2. The multi-ply form or label of claim 1 in which said top ply includes perforations interiorly of said adhesive to permit removal of said top ply from the remainder of said form.

3. The multi-ply form or label of claim 1 in which said lower surface of said top ply which faces said intermediate ply includes at least one area printed with a first composition which, when exposed to a second composition, reacts to form a distinctive color, with at least one of said first and second compositions being contained in frangible microcapsules.

4. The multi-ply form or label of claim 1 in which the upper surface of said intermediate ply includes at least one area printed with said second composition which, when exposed to said first composition on said top ply, reacts to form a distinctive color.

5. The multi-ply form of claim 1 in which the lower surface of said base ply includes an adhesive selected from the group consisting of water remoistenable adhesives and pressure sensitive adhesives.

6. The multi-ply form of claim 1 in which said base ply extends beyond at least one edge of said intermediate ply.

7. The multi-ply form of claim 3 in which said top ply includes at least one area which has been die cut to expose a portion of the upper surface of said intermediate ply.

8. The multi-ply form of claim 4 including human or machine readable indicia printed on each of said top, intermediate, and base plies.

9. The multi-ply form of claim 1 in which said lower surface of said top ply is secured to said upper surface of said intermediate ply along three marginal edges thereof.

10. The multi-ply form or label of claim 1 in which the upper surface of said top ply includes at least one area printed with a first composition which, when exposed to a second composition, reacts to form a distinctive color, with at least one of said first and second compositions being contained in frangible microcapsules, said second composition being present blended with said first composition.

11. The multi-ply form or label of claim 1 in which said upper surface of said base ply further includes printed indicia forming a message which is hidden from view until said base and intermediate plies are separated.

12. The multi-ply form or label of claim 1 in which said top and intermediate plies are secured together along three marginal edges thereof by said adhesive to form a return envelope, the upper surface of said top ply including at least one area printed with a first composition which, when exposed to a second composition, reacts to form a distinctive color, with at least one of said first and second compositions being contained in frangible microcapsules, and said second composition being in contact with said first composition.

13. The multi-ply form or label of claim 12 in which the lower surface of said base ply includes an adhesive selected from the group consisting of water remoistenable adhesives and pressure sensitive adhesives.

14. The multi-ply form or label of claim 12 in which said top ply includes a removable stub along one edge thereof, and the upper surface of said intermediate ply facing said top ply includes a coating of a remoistenable adhesive in the area directly beneath said removable stub.

15. The multi-ply form or label of claim 1 in which said top and intermediate plies are secured together along three marginal edges thereof by said adhesive to form a pocket, the upper surface of said top ply including at least one area printed with a first composition which, when exposed to a second composition, reacts to form a distinctive color, with at least one of said first and second compositions being contained in frangible microcapsules, said second composition being in contact with said first composition; and said upper surface of said base ply further including printed indicia forming a message which is hidden from view until said base and intermediate plies are separated.

16. The multi-ply form or label of claim 15 including a coupon inserted into said pocket formed by said top and intermediate plies.

17. The multi-ply form or label of claim 15 in which the lower surface of said base ply includes an adhesive selected from the group consisting of water remoistenable adhesives and pressure sensitive adhesives.

* * * * *